United States Patent [19]

Sehres

[11] 4,454,409

[45] Jun. 12, 1984

[54] BRA-SIZE CALCULATOR

[76] Inventor: Lynn Sehres, 2730 W. Van Buren, Phoenix, Ariz. 85009

[21] Appl. No.: 358,018

[22] Filed: Mar. 15, 1982

[51] Int. Cl.[3] ..... G06C 1/00

[52] U.S. Cl. ..... 235/78 R; 235/78 RC; 235/88 R; 235/88 RC

[58] Field of Search ..... 235/78 R–78 RC, 235/88 R–88 RC

[56] References Cited

U.S. PATENT DOCUMENTS

| | | | |
|---|---|---|---|
| 3,050,249 | 8/1962 | Awramik, Jr. et al. | 235/88 R |
| 3,106,030 | 10/1963 | Pelosi | 235/88 G |
| 4,137,448 | 1/1979 | Smith | 235/78 G |

*Primary Examiner*—L. T. Hix
*Assistant Examiner*—Della Rutledge
*Attorney, Agent, or Firm*—James F. Duffy

[57] ABSTRACT

A convenient, easy-to-use calculator computes a person's proper bra and cup size given a knowledge of that person's chest, overbust, and band measurements. The calculator comprises a circular slide rule of three superimposed disks, the intermediate disk being of larger diameter than the upper disk and the lower disk being of larger diameter than the intermediate disk. The three disks are mounted for relative rotation by means of an axially disposed pivot, pin, rivet, or other means transfixing the disks for ease of rotation about their centers. Scalar indicia at the periphery of the disks represent body measurements required for the determination of proper bra size. Proper bra and cup size are viewable through circular indexes when a person's chest and overbust measurements are aligned on the two outermost peripheral scales and the person's underbust or band measurement is aligned with a fixed index on the intermediate disk.

8 Claims, 4 Drawing Figures

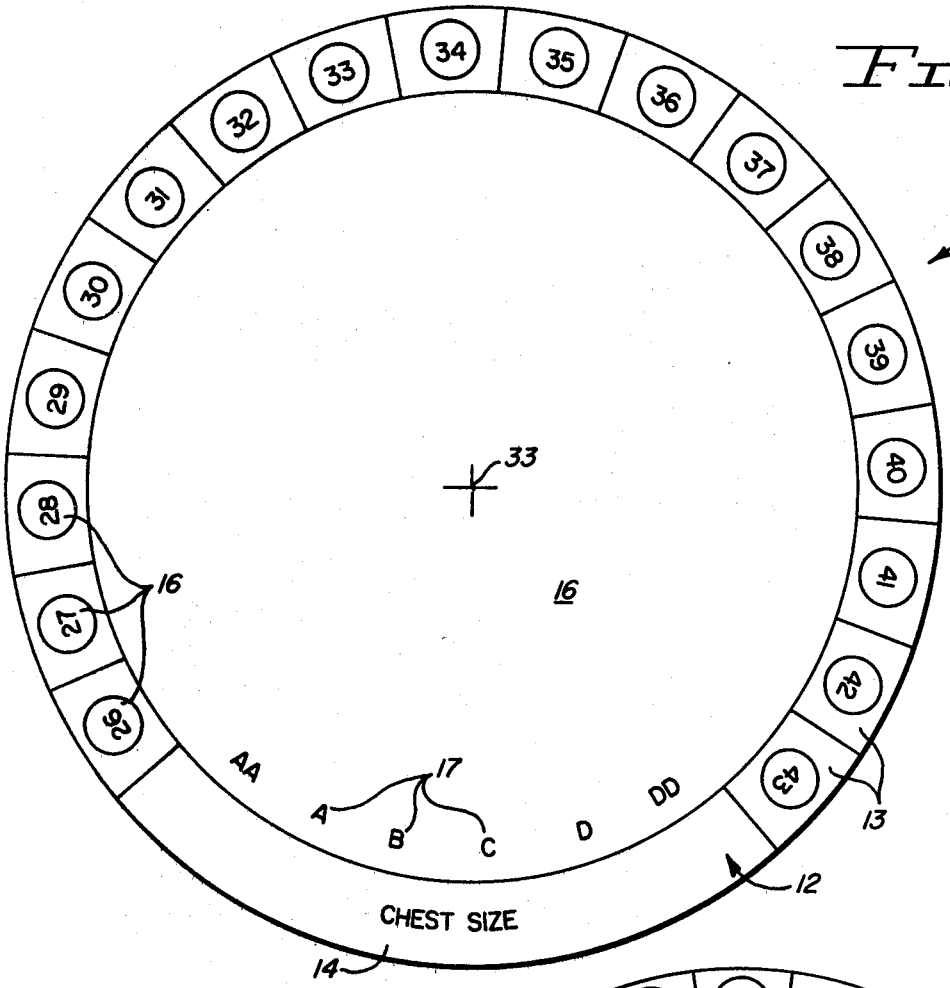
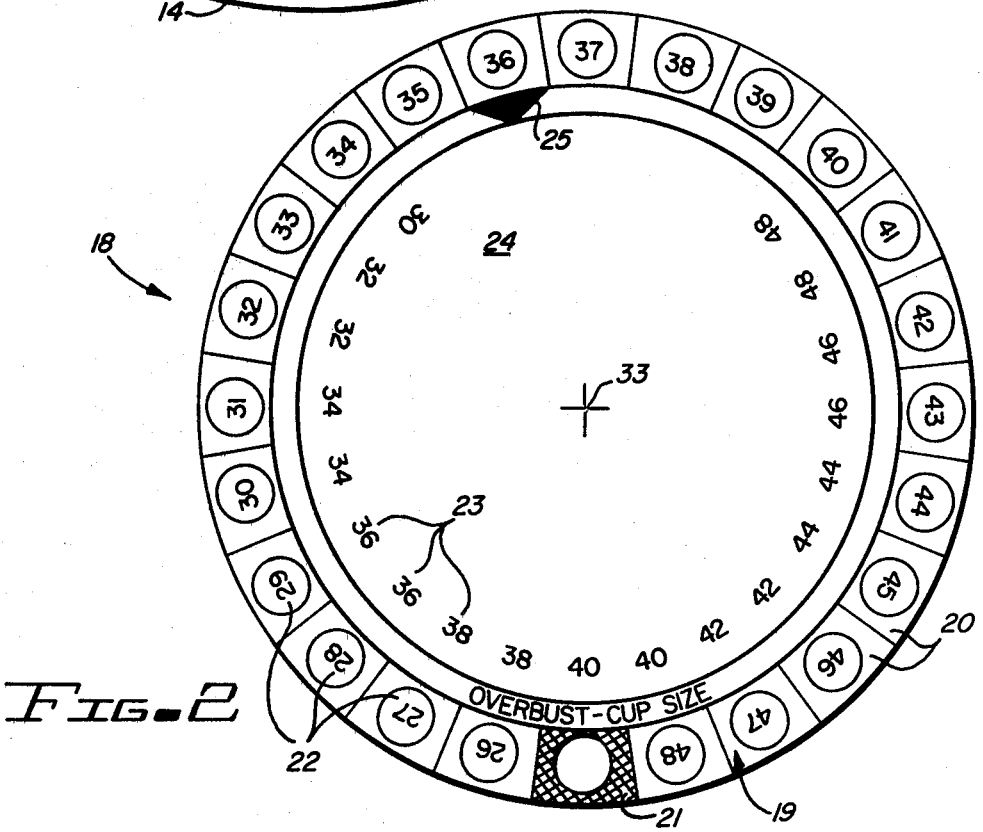
FIG. 2

BRA-SIZE CALCULATOR

BACKGROUND

1. Field of the Invention

The invention relates to the field of calculating devices.

The invention particularly relates to portable slide rule type calculating devices.

The invention specifically relates to a calculating device for determining a person's proper bra size.

2. Prior Art

Slide rules are well known calculators which are provided in various styles and sizes. There are relatively flat slide rules having members movable linearly, one with respect to another, and disc and cylindrical slide rules wherein the moving members rotate about a common axis.

Special purpose calculators are also familiar to those skilled in the prior art. Such specialized slide rule calculators include those for calculating electrical wire sizes, energy consumption by household appliances, the number of board feet of lumber contained within a tree log, the volume of a room, etc.

While the high accuracy, simplicity of operation, and relatively low cost of today's electronic calculators has generally replaced the slide rule for general and engineering calculations, the hand-operated slide rule for specialized calculations still finds popular acceptance. This is particularly true where the elements of a given calculation are involved, not readily memorized, or are given to misunderstanding. Because of these factors, it is believed that the bra-size calculator disclosed herein will find ready acceptance.

Early in the last decade a bra manufacturer sent out a call for women to model a size 34B bra. Over two hundred applicants applied, each believing they were size 34B. Only two of the two hundred applicants were found to be size 34B.

A brochure published by International Playtex, Inc. in 1979 notes that seven out of ten women may be wearing the wrong size bra. Seven pages of that brochure are then employed to describe and detail the manner in which a woman should measure her figure and manipulate those measurements to determine her proper bra and cup size. The directions instruct the woman to measure around her bra band or her underbust and add five to that measurement to determine her bra size unless, of course, the addition of five to the band measurement results in an odd number in which case the woman shall add six to the band measurement to determine her proper bra size.

Having found her bra size in accordance with the above method, the woman is then instructed to make an overbust measurement about the fullest part of her bust. This overbust measurement is to be compared with the bra size just determined. The proper cup size is then given in terms of the following tabulation:

| If overbust measure is: | Cup Size is: |
|---|---|
| up to ½ inch larger than bra size | AA |
| up to 1 inch larger than bra size | A |
| up to 2 inches larger than bra size | B |
| up to 3 inches larger than bra size | C |
| up to 4 inches larger than bra size | D |
| up to 5 inches larger than bra size | DD |

The picture is further clouded by the fact that professional undergarment manufacturers and fitters employ a third measurement made above the fullness of the bust and close to the underarms. This measurement takes into account the fact that the fullness of a women's bust, which extends to the side of her torso and under her arms, affects the proper fit of the bra and therefore is determinative of the correct bra size.

It is therefore an objective of the invention to provide a convenient means for calculating proper bra and bra cup sizes based on the three measurements: chest, overbust, and band; utilized by professional undergarment fitters.

It is a particular objective of the invention to provide a simple-to-use, conveniently carried, inexpensive bra size calculator.

It is a specific objective of the invention to provide a bra size calculator in the form of a slide rule which a woman, armed with her chest, overbust, and band measurements, may readily utilize to determine her correct bra and cup size.

SUMMARY OF THE INVENTION

The invention discloses a calculator for use in determining the proper bra size of a person, given that person's chest, overbust, and band, or underbust, physical measurements. The calculator comprises first scalar presentation means bearing indicia thereon overbust measurements and including a first index position thereon. A second scalar presentation means bearing indicia, representative of chest measurements, is movably coupled to said first scalar presentation means and further comprises bra size indicia alignable with said first index position when a person's overbust measurement on said first scalar presentation means is aligned with that person's chest measurement on said second scalar presentation means wherein the bra cup size indicia, aligned with said first index position, is determined and presented as the difference between said chest and said overbust measurements.

The calculator further comprises a second index position on the first scalar presentation means as well as a third scalar presentation means bearing indicia representative of band, or underbust, measurements. This third scalar presentation means is movably coupled to the first scalar presentation means and includes a third index position thereon. Bra size indicia on the first scalar presentation means are alignable with the third index position on the third scalar presentation means such that when a person's band, or underbust, measurement on the third scalar presentation means is aligned with said second index position on the first scalar presentation means, the bra size indicia, aligned with said third index position, differs from the person's band, or underbust, measurement by a commercially established, industry standard constant.

The bra cup size indicia of the calculator comprise the alphabetical indicia AA, A, B, C, D, and DD. Respective ones of these bra cup size indicia align with said first index position when the difference between said chest and said overbust measurement is: (aa) less than one inch; (a) one inch; (b) two inches; (c) three inches; (d) four inches; (dd) five inches, respectively.

In one embodiment of the calculator disclosed and claimed herein, the commercially established, industry standard constant selected is that wherein the bra size indicia alignable with the third index position comprise indicia differing from a person's band or underbust measurement by five when the band or underbust-measurement-plus-five is an even number and by six when the band or underbust-measurement-plus-five is an odd number.

In a preferred embodiment of the invention, the calculator comprises three scalar presentation means wherein the measurement indicia are presented in an annular arrangement, all three scalar presentation means being movably coupled for independent movement about a common center. Thus, the first scalar presentation comprises a first annular arrangement of overbust size indicia at the periphery of an intermediate sized disk. The second scalar presentation comprises a second annular arrangement of chest size indicia at the periphery of a larger sized disk. The third scalar presentation comprises a third annular arrangement of band or underbust size indicia at the periphery of a smaller sized disk.

DESCRIPTION OF THE DRAWINGS

FIG. 1 illustrates scalar presentation means comprising an annular arrangement of chest size indicia at the periphery of a large size disk.

FIG. 2 illustrates a scalar presentation of overbust size indicia in annular arrangement at the periphery of an intermediate size disk.

DETAILS OF THE INVENTION

Figure 3:
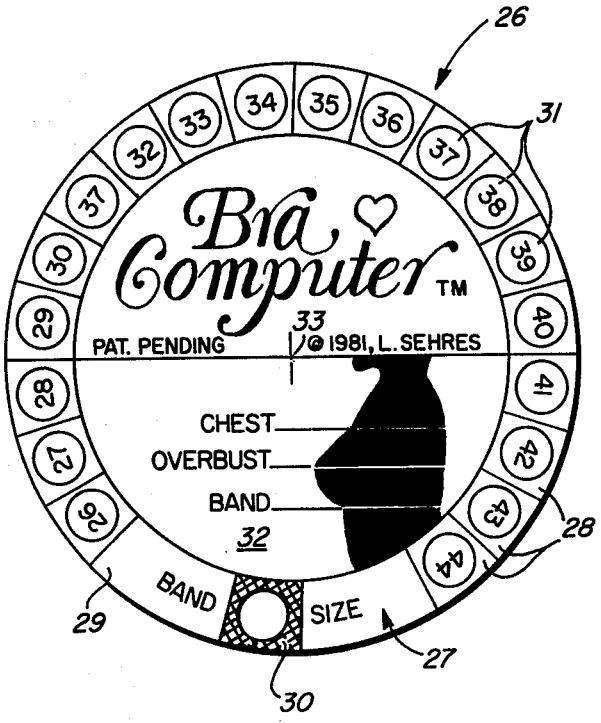
FIG. 3 illustrates a third scalar presentation comprising an annular arrangement of band or underbust size indicia at the periphery of a smaller sized disk.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device; and such further applications of the principles of the invention as illustrated herein being contemplated as would normally occur to one skilled in the art to which the invention relates.

Figure 4:
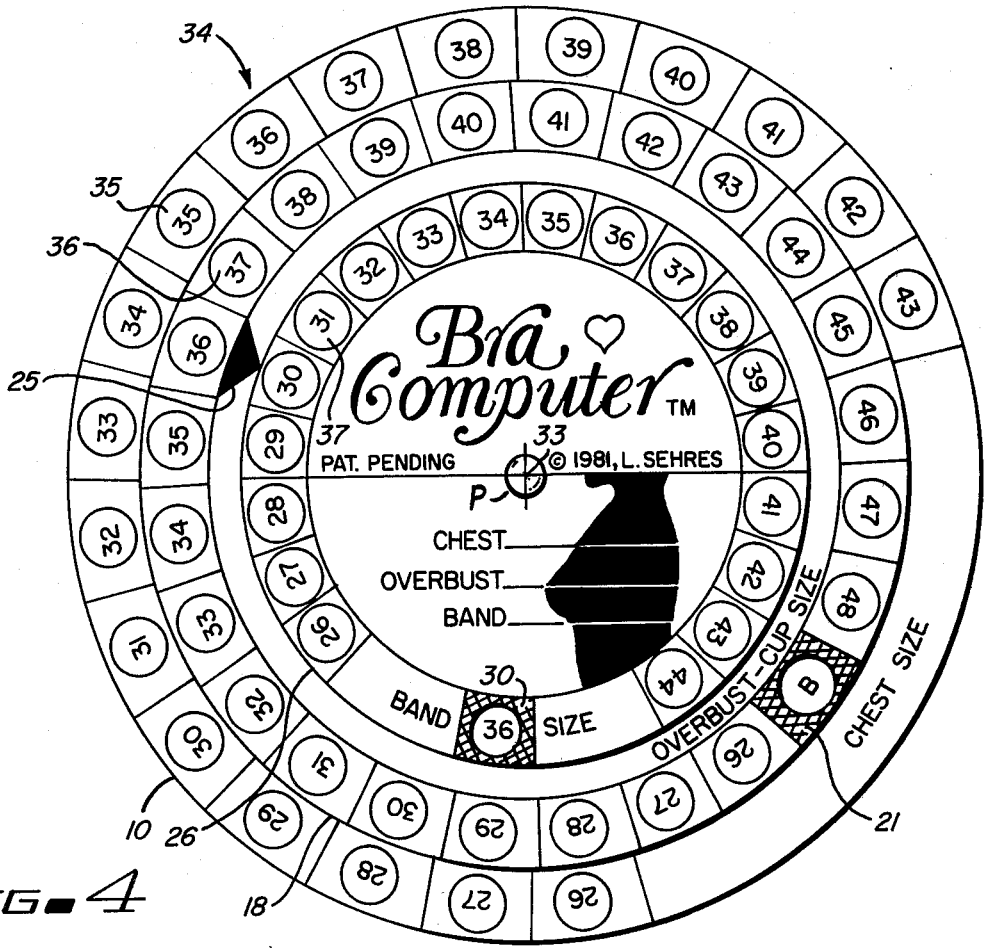
FIG. 4 is an assembled bra size calculator illustrating the manner in which the annular arrangements of size indicia are coupled one to another for independent movement about a common center.

The bra size calculator preferably comprises three superimposed disks 10, 18 and 26, preferably of a suitable relatively stiff material, the intermediate disk 18 being of larger diameter than the upper disk 26 and the lower disk 10 being of larger diameter than the intermediate disk 18. The three disks are mounted for relative rotation by means of an axially disposed pivot pin, rivet, or other means P, coupling the three disks for independent rotation about the center 33. The above construction is best seen in the illustration of FIG. 4.

The lower, larger sized disk 10 is comprised of an annular ring 12 at the periphery of the disk. A major portion of annular ring 12 is subdivided into equally spaced segments 13 and a large segment 14. Annular ring 12 defines an inner circle 15. The large segment 14, of annular ring 12, identifies the numerals 16 contained within the small segments 13 of annular ring 12 as indicia of a person's chest size. The chest size indicia 16 are indicated here as the size of a person's chest measurement in inches. Other scalar measurements, such as centimeters, would serve equally as well. Letter indicia 17, representative of bra cup size, are presented within inner circle 15 as defined by annular ring 12 and adjacent to the periphery of inner circle 15.

Intermediate sized disk 18 comprises an annular ring 19 which is broken into smaller equally spaced segments 20. With the exception of shaded segment opening 21, each segment 20 of annular ring 19 bears the indicia 22 representative of a person's overbust measurements in inches. As before, any convenient scalar unit may be utilized. Annular ring 19 defines an inner field 24 of disk 18. Herein is indicated a first index position 25 and an annular array of bra size indicias 23.

When intermediate size disk 18 is superimposed on large size disk 10 so that centers 33 coincide, the bra cup size indicia 17 of disk 10 are viewable through shaded segment opening 21 when a selected one of the overbust size indicia 22 is aligned with a selected one of the chest size indicia 16. The indicia 17 of bra cup sizes are presented through shaded segment opening 21 in accordance with the tabulation of bra cup sizes set forth in the background discussion herein.

Small disk 26 is comprised of annular ring 27 which is subdivided into smaller segments 28 of equal size and spacing. A large segment 27 accommodates shaded segment opening 30 to be used as an index for viewing the indicia of bra sizes established by use of the bra size calculator. Indicia 31, representative of a person's band size measurements, are set forth within segments 28 of annular ring 27.

When small disk 26 is superimposed atop intermediate size disk 18 such that centers 33 coincide, and a selected one of the indicia of a person's band size measurement 31 is positioned adjacent to index 25, an appropriate one of the bra size indicia 23 presented within the inner field 24 of intermediate size disk 18 will be viewable through shaded segment opening 30. Using a presently accepted industry standard, the bra size viewable through shaded segment opening 30 will differ from a person's band or underbust measurement as aligned with index 25 by five when the band or underbust-measurement-plus-five is an even number and by six when the band or underbust-measurement-plus-five is an odd number. However, any commercially acceptable industry standard may be utilized in setting forth the various measurement indicia on the bra size calculator.

As already noted in this description of the invention, FIG. 4 illustrates the assembled bra size calculator 34. When the selected one of the indicia of a person's chest size 35 is aligned with a selected one of the indicia of a person's overbust measurement, the proper bra cup size appears in the index provided by shaded segment opening 21. When a person's band or underbust measurement 37 is aligned with index 25, the proper bra size is indicated and presented for viewing through shaded segment opening 30. Thus, in the illustration as shown in FIG. 4, a person having a chest measurement 35 of thirty-five inches, an overbust measurement 36 of thirty-seven inches, and a band or underbust measurement 37 of thirty inches, will select a bra size thirty-six as indicated in shaded segment opening 30 and of cup size B as indicated in shaded segment opening 21.

What has been disclosed is a convenient, easy-to-use calculator for computing a person's proper bra and cup size given a knowledge of that person's chest, overbust, and band measurements. The calculator comprises a circular slide rule of three superimposed disks, the intermediate disk being of larger diameter than the upper disk and the lower disk being of larger diameter than the intermediate disk. The three disks are mounted for relative rotation by means of an axially disposed pivot, pin, rivet, or other means transfixing the disks for ease of rotation about their centers. Scalar indicia at the periphery of the disks represent body measurements required for the determination of proper bra size. Proper bra and cup size are viewable through circular indexes when a person's chest and overbust measurements are aligned on the two outermost peripheral scales and the person's underbust or band measurement is aligned with a fixed index on the intermediate disk.

A presently preferred embodiment of the invention has been disclosed. Those skilled in the art will readily anticipate modifications of this embodiment drawn from the teachings herein. To the extent that such modifications are so drawn, it is intended that they shall fall within the ambit of protection provided by the claims appended hereto.

Having disclosed my invention in the foregoing specification and drawings in such a clear and concise manner that those skilled in the art may readily understand and practice the invention, that which I claim is:

1. A bra size calculator for use in determining the proper bra cup size of a person given that person's chest, overbust, and band or underbust physical measurements comprising:

a first disk having thereon a scalar presentation in numeric sequence of overbust measurements and including a first index position thereon;

a second disk having thereon a scalar presentation in numeric sequence of chest measurements and movably coupled to said first disk and having alphabetical bra cup size indicia alignable with said first index position when a person's overbust measurement on said first disk's scalar presentation is aligned with that person's chest measurement on said second disk's scalar presentation.

2. The calculator of claim 1 further comprising means for determining bra size, said means comprising:

a second index position on said first scalar presentation;

a third disk having thereon a scalar presentation in numeric sequence of band or underbust measurements movably coupled to said first disk and including a third index position thereon; and a numeric sequence of bra size indicia on said first disk alignable with said third index position when a person's band or underbust measurement on said third disk's scalar presentation is aligned with said second index position on said first disk which bra size indicia when aligned with said third index position differs from the person's band or underbust measurement by a commercially established, industry standard constant.

3. The calculator of claim 1 or claim 2 wherein the bra cup size indicia alignable with said first index position comprise the alphabetical indicia AA, A, B, C, D, and DD which align with said first index position when the scalar presentations of overbust measurement on said first disk and said chest measurement on said second disk differ by:

(AA) less than 1 inch;
(A) 1 inch;
(B) 2 inches;
(C) 3 inches;
(D) 4 inches;
(DD) 5 inches, respectively.

4. The calculator of claim 2 wherein the bra size indicia alignable with said third index position comprise indicia differing from a person's band or underbust measurement by five inches when the band or under-bust-measurement-plus-five-inches is an even number and by six inches when the band or under-bust-measurement-plus-five-inches is an odd number.

5. The calculator of claim 4 wherein the bra cup size indicia alignable with said first index position comprise the alphabetical indicia AA, B, C, D, and DD which align with said first index position when the scalar presentations of overbust measurements on said first disk and said chest measurments on said second disk differ by:

(AA) less than 1 inch;
(A) 2 inches;
(C) 3 inches;
(D) 4 inches;
(DD) 5 inches respectively.

6. The calculator of claim 5 wherein said first disk is an intermediate sized disk and said scalar presentation thereon comprises a first annular arrangement of overbust size indicia in numeric sequence at the periphery of said intermediate sized disk;

said second disk is a larger sized disk and said scalar presentation thereon comprises a second annular arrangement of chest size indicia in numeric sequence at the periphery of said larger sized disk;

said third disk is a smaller sized disk and said third scalar presentation thereon comprises a third annular arrangement of band or underbust size indicia in numeric sequence at the periphery of said smaller sized disk; and further comprising:

coupling means for movably coupling said first, second and third disks with their annular size indicia arrangements thereon each for independent movement about a common center.

7. A slide rule bra size calculator for informing a woman of her correct bra and cup sizes without the need for mental calculations which slide rule bra size calculator comprises:

(a) three superimposed disks comprising:

a base disk having a peripheral scale graduated with a sequence of numbers which numbers each represent a measurement of a woman's chest dimension and an inner scale graduated with letters each representative of a bra cup size;

an intermediate disk having a peripheral scale graduated with numbers each representative of a measurement of a women's overbust dimension and an inner scale graduated with numbers each representative of a bra size; and an upper disk having a peripheral scale graduated with numbers representative of a measurement of a woman's band, i.e. under-the-bust, dimension, said upper disk generally obscuring said inner scale of said intermediate disk, and said intermediate disk generally obscuring said inner scale of said base disk when said three disks are superimposed with their centers aligned;

(b) means for coupling said three superimposed disks, each to the others, for relative rotation of each said disk to the others;

(c) a viewing aperture in the periphery of said intermediate disk for viewing a selected one of said letters on said inner scale of said base disk representative of a woman's proper cup size when a selected number on said base disk's peripheral scale representative of a woman's chest dimension is aligned with a selected number on the intermediate disk's peripheral scale representative of a woman's overbust dimension;

(d) an index mark on said intermediate disk for aligning with a selected number on said upper disk's peripheral scale representative of a woman's underbust measurement; and (e) a viewing aperture in the periphery of said upper disk for viewing a selected one of said numbers on said inner scale of said intermediate disk representative of a women's proper bra size when a selected number on said upper disk's peripheral scale is aligned with said index mark on said intermediate scale;

whereby a woman is informed of her proper bra and bra cup sizes without the need for mental calculations by viewing the number and letter exposed within said viewing apertures.

8. A method for informing women of their correct bra and bra cup sizes using a slide rule bra size calculator having three superimposed disks independently rotatable about their aligned centers the upper, intermediate, and lower of said superimposed disks having scales graduated respectively in dimensions representative of a women's underbust, overbust and chest measurements, said intermediate disk also having bra size scale gradations selectedly viewable through an indexing aperture in said upper disk and an index mark alignable with said chest size scale graduations on said upper disk, said lower disk also having bra cup size scale gradations selectedly viewable through an indexing aperture in said intermediate disk, said method for so informing women of their correct bra and bra cup sizes by using said slide rule comprising the steps of:

(a) aligning a women's chest measurement as found on the scalar gradations on said lower disk with the woman's overbust measurement as found on the scalar gradations on said intermediate disk;

(b) viewing the women's proper bra cup size as bound on the scalar gradation on said lower disk viewable through the indexing aperture in said intermediate disk;

(c) aligning the index mark on said intermediate disk with the women's underbust measurement as found on the scalar gradations on said upper disk; and (d) viewing the woman's proper bra size as found on the scalar gradations on said intermediate disk viewable through the indexing aperture in said upper disk.

* * * * *